US006039366A

United States Patent [19]

Lewis

[11] Patent Number: 6,039,366

[45] Date of Patent: Mar. 21, 2000

[54] DOOR HANDLE ASSEMBLY AND METHOD OF MOUNTING

[75] Inventor: Jimmie Lewis, Rockledge, Fla.

[73] Assignee: Adac Plastics, Inc., Grand Rapids, Mich.

[21] Appl. No.: 09/041,772

[22] Filed: Mar. 13, 1998

[51] Int. Cl.[7] ..... E05C 21/00

[52] U.S. Cl. ..... 292/352; 292/DIG. 64

[58] Field of Search ..... 292/336.3, 347, 292/348, 350, 352, DIG. 31, DIG. 56, DIG. 64, DIG. 73; 248/575, 27.3, 231.81; 403/256, 258, 259, 260

[56] References Cited

U.S. PATENT DOCUMENTS

| | | | |
|---|---|---|---|
| 1,400,482 | 12/1921 | Ewing . | |
| 1,544,464 | 6/1925 | Long . | |
| 2,292,612 | 8/1942 | Carmichael . | |
| 2,915,265 | 12/1959 | Tiger . | |
| 3,858,921 | 1/1975 | Kuki . | |
| 3,967,844 | 7/1976 | Torii . | |
| 4,693,503 | 9/1987 | Bisbing . | |
| 4,892,342 | 1/1990 | Newman | 292/347 |
| 4,898,415 | 2/1990 | Satoh . | |
| 5,064,228 | 11/1991 | Bisbing . | |
| 5,238,276 | 8/1993 | Burns . | |
| 5,248,175 | 9/1993 | Burns . | |
| 5,282,657 | 2/1994 | Clinch et al. . | |
| 5,284,373 | 2/1994 | Watson . | |
| 5,340,174 | 8/1994 | Bender et al. . | |
| 5,352,004 | 10/1994 | Nedbal | 292/347 |
| 5,377,450 | 1/1995 | Varajon . | |
| 5,499,851 | 3/1996 | Mitchell . | |
| 5,560,659 | 10/1996 | Dault . | |
| 5,609,373 | 3/1997 | Gromotka . | |

*Primary Examiner*—B. Dayoan
*Assistant Examiner*—Gary Estremsky
*Attorney, Agent, or Firm*—Young & Basile, P.C

[57] ABSTRACT

An automotive door handle assembly includes an escutcheon sized to fit in a door aperture; a handle pivotally mounted on the escutcheon; a fastener device extending rearwardly from the escutcheon; and a clip of U-configuration having a bight portion and upper and lower leg portions extending forwardly from opposite edges of the bight portion in outwardly splayed relation with an aperture in the bight portion fitted over the fastener device to position the clip rearwardly of the escutcheon with the leg portions extending forwardly in embracing relation to the escutcheon. A resilient cushion member is fitted between the clip upper leg portion and the adjacent surface of the escutcheon and dimples upstand from the clip lower leg portion for slidable engagement with the adjacent escutcheon surface. As the fastener device is tightened, following pivotal positioning of the handle assembly in the door aperture, the clip moves forwardly to bring clamping edge portions of the upper and lower clip leg portions into clamping engagement with the inner face of the door skin while the resilient cushion member compresses to facilitate the forward movement of the upper leg portion and the dimples on the lower leg portion slide on the adjacent escutcheon surface to facilitate the forward movement of the lower leg portion. After engaging the door skin, further tightening of the fastener device causes the free ends of the upper and lower leg portions to splay outwardly to produce a spring force to augment the mounting force exerted by the clip.

7 Claims, 2 Drawing Sheets

DOOR HANDLE ASSEMBLY AND METHOD OF MOUNTING

BACKGROUND OF THE INVENTION

This invention relates to door handle assemblies and more particularly to door handle assemblies that are especially adapted for use on motor vehicles.

The cost of assembling a motor vehicle is an ongoing concern. One of the assembly costs is the labor cost required to install the motor vehicle door handle assemblies in the vehicle doors.

SUMMARY OF THE INVENTION

This invention is directed to the provision of door handle assembly that may be installed in a motor vehicle door with a minimum of labor costs.

The door handle assembly of the invention is adapted to be mounted in an aperture in an outer skin of a motor vehicle door. According to the invention, the handle assembly includes an escutcheon plate sized to fit in the door aperture; a handle pivotally mounted on the escutcheon plate; a threaded fastener device secured to the escutcheon plate and extending rearwardly therefrom; and a clip of U-configuration having a bight portion and upper and lower leg portions extending forwardly from opposite edges of the bight portion in outwardly splayed, outwardly diverging disposition relative to each other and having an aperture in the bight portion fitted over the threaded fastener device to position the clip rearwardly of the escutcheon plate with the clip leg portions extending forwardly in embracing relation to the escutcheon plate. With this arrangement, once the door handle assembly has been installed in the aperture of the vehicle door skin, the mounting of the door handle assembly may be completed simply by manipulating the threaded fastener device in a tightening sense to move the clip forwardly and move the upper and lower leg portions into clamping relation with the door skin.

According to further feature of the invention, the handle assembly further includes a resilient cushion member fitted between one of the leg portions of the clip and an adjacent surface of the escutcheon plate and operative to compress in response to the tightening of the fastener device. The resilient cushion serves to stabilize and define the preinstalled handle assembly package and further serves to define and guide the forward movement of the clip in response to tightening of the threaded fastener device. In the disclosed embodiment the invention, the one clip leg portion is the upper clip leg portion.

According to further feature of the invention the handle assembly further includes slide means positioned between the lower leg portion of the clip and an adjacent escutcheon plate surface to facilitate sliding movement of the lower clip leg on the adjacent escutcheon plate surface in response to tightening of the fastener device. This arrangement, in combination with the cushion, further serves to define and guide the forward movement of the clip in response to tightening of the fastener device. In the disclosed embodiment of the invention, the slide means comprises a plurality of dimples upstanding from the front face of the lower leg portion of the clip and slidably engaging the adjacent escutcheon plate surface.

The invention also defines an improved methodology for mounting an automotive door handle assembly in an aperture in an outer skin of a motor vehicle door. According to the invention methodology, the door handle assembly, including the clip, is passed through the aperture in the outer skin of the door to position a circumferential flange on the escutcheon plate against the outer face of the outer door skin in surrounding relation to the aperture and position the clip inside the door with the upper and lower clamping edges of the upper and lower leg portions positioned proximate upper and lower portions of the edge of the door skin aperture; and the threaded fastener device is thereafter tightened from a location inside the door to move the clip forwardly with respect to the escutcheon plate and move the free clamping edges of the clip leg portion against the upper and lower portions of the edge of the door skin aperture to firmly mount the door handle assembly in the door aperture. With this methodology, the clip functions to secure the door handle assembly in the door aperture along upper and lower edge portions of the door aperture and yet requires only tightening of the threaded fastener device following passage of the door handle assembly through the aperture in the door skin.

According to a further feature of the invention methodology, the upper and lower clamping edges of the upper and lower clip leg portions splay outwardly in response to forward movement of the threaded fastener device. This outward splaying spring movement loads the leg portions of the clip to augment the clamping action exerted against the door skin by the clip.

According to further features of the invention methodology, the resilient cushion associated with the upper clip leg portion and the slide means associated with the lower clip leg portion facilitate the forward clamping movement of the clamp in response to the tightening of the threaded fastener device, and the aperture in the bight portion of the clip is oversized with respect to the threaded fastener device so as to allow the clip to pivotally adjust relative to the escutcheon plate as it moves forwardly into clamping engagement with the door skin.

DETAILED DESCRIPTION OF THE PREFERRED EMBODIMENT

Figure 1:
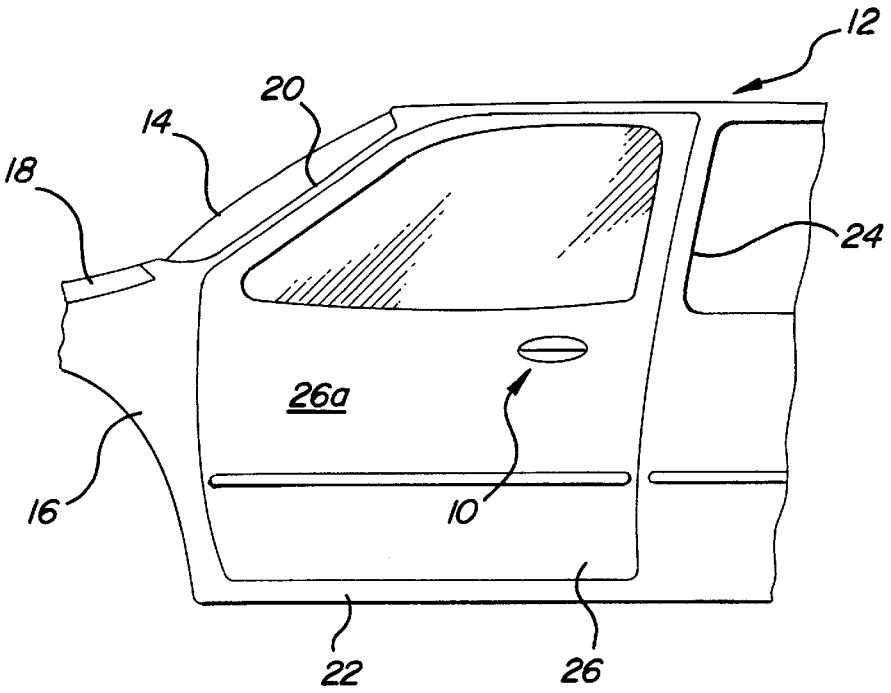
FIG. 1 is a fragmentary view of a motor vehicle embodying a door handle assembly according to the invention.
Figure 2:
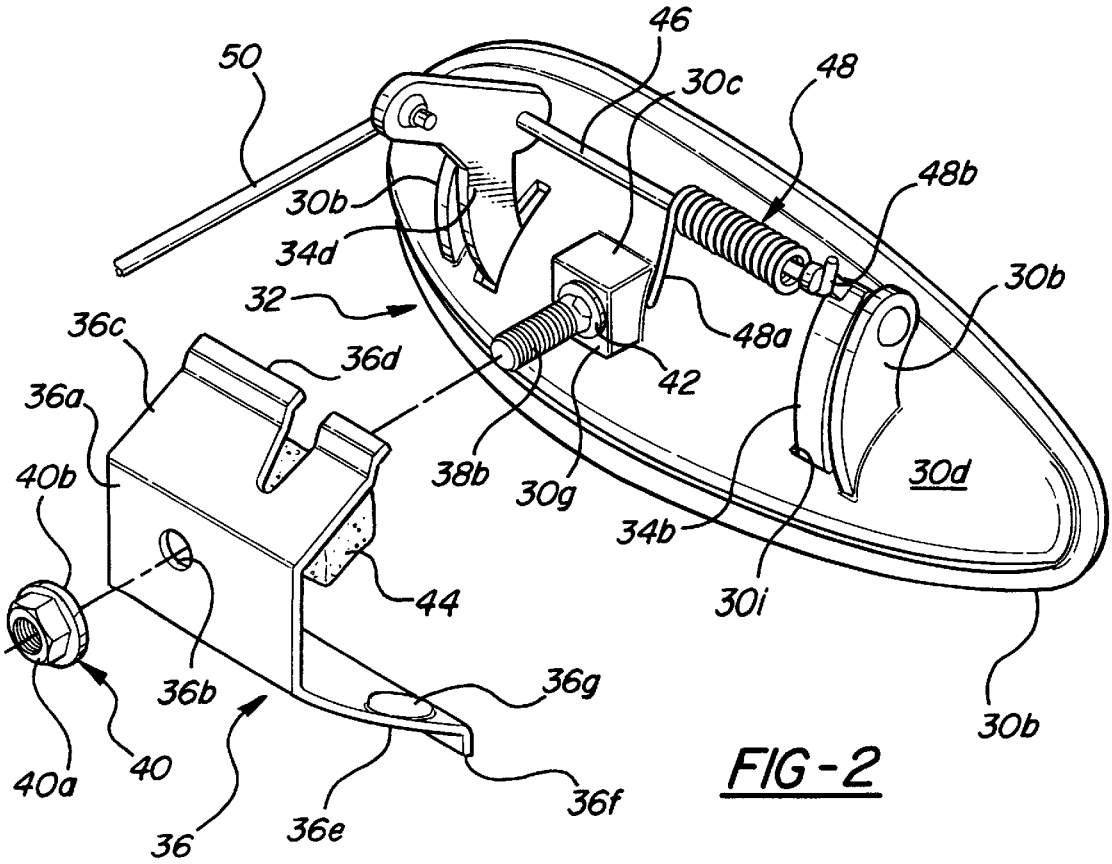
FIG. 2 is a perspective, exploded view of the invention door handle assembly.

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by A pillar 20, front quarter panel 16, sill 22 and B pillar 24 and including an outer skin 26*a*.

Door handle assembly 10, broadly considered, includes an escutcheon or housing 30, a fastener assembly 32, a handle 34, and a clip or clamp 36.

Escutcheon 30 is preferably formed as a molded plastic part and includes a main body bowl portion 30*a*, a flange portion 30*b* extending around the entire periphery of bowl portion 30*a*, and a platform portion 30*c* extending rearwardly from the rear face 30*d* of main body bowl portion 30*a*.

Threaded fastener assembly 32 comprises a bolt 38, a nut assembly 40 including a nut 40*a* and washer 40*b* peened to the nut, and a circlet lock 42. The head 38*a* of bolt 38 is positioned in a recess 30*e* in the front face of escutcheon platform portion 30*c* and extends rearwardly through an aperture 30*f* in the platform portion to position the threaded shaft 38*b* of the bolt in a rearwardly extending position relative to the rear face 30*g* of platform portion 30*c*. Circlet lock 42 is positioned lockingly over threaded shaft 38*b* and against rear platform face 30*g* to lock the bolt in position relative to the escutcheon plate.

Handle 34 is preferable formed as a molded plastic part and includes an elongated main body portion 34*a*, an arm or lug 34*b* extending upwardly and rearwardly from main body portion 34*a* and including a hook portion 34*c* at the free end of the lug, and an arm or lug 34*d* extending upwardly and rearwardly from main body portion 34*a* in laterally spaced relation to lug 34*b* and having a crank arm configuration including a crank arm portion 34*e*.

Clip or clamp 36 is preferably formed as a spring steel sheet metal stamping and has a generally U-shaped configuration in cross section including a bight portion 36*a* with an aperture 36*b*; an upper leg portion 36*c* defining a clamping free edge flange 36*d*; and a lower leg portion 38*e* defining a clamping free edge flange 36*f* and dimples 36*g*. Upper and lower leg portions 36*c*, 36*e* extend forwardly from opposite upper and lower edges of bight portion 36*a* in outwardly splayed, outwardly diverging disposition relative to each other. A resilient cushion member 44, formed of a suitable foam material or the like, is adhesively secured to the front or under face of clip upper leg portion 36*c* and extends the full width of the upper leg portion. Aperture 36*b* in clip bight portion 36*a* is oversized with respect to the threaded shaft 38*b* of bolt 38.

Figure 5:
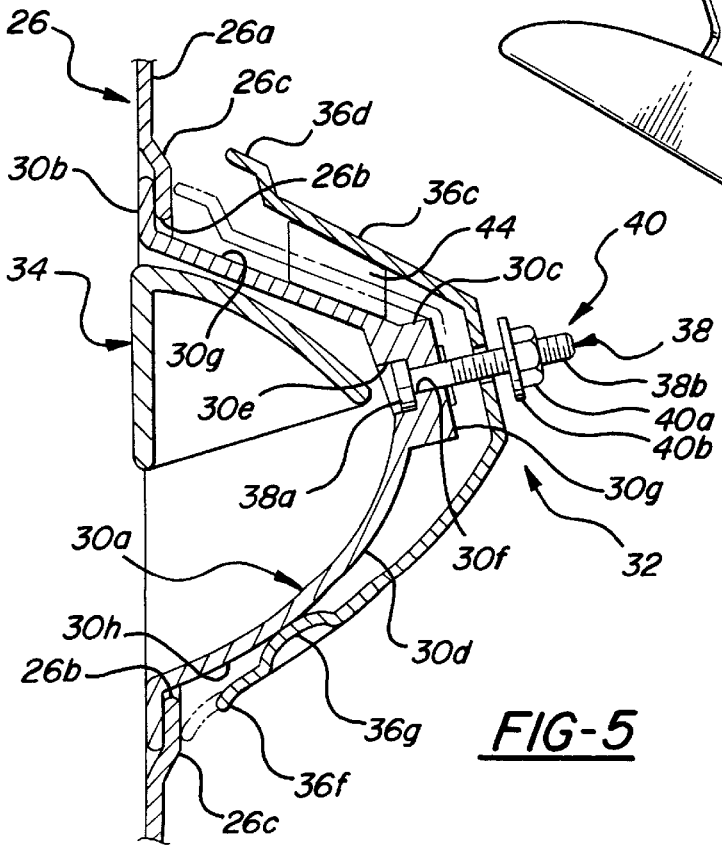
FIG. 5 illustrates the door handle assembly installed in the vehicle door.

In the assembled relation of the handle assembly, aperture 36*b* of clip bight portion 36*a* is positioned over the threaded shaft portion 38*b* of bolt 38 with upper and lower clip legs 36*c* and 36*e* extending forwardly from upper and lower edges of the bight portion in diverging outwardly splayed directions in embracing relation to the main body portion 30*a* of the escutcheon plate; nut 40*a* is threaded onto the shaft 38*b* to position the nut washer 40*b* proximate clip bight portion 36*a*; cushion member 44 is positioned between clip upper leg portion 36*c* and the confronting surface 30*g* of escutcheon plate 30 in generally relaxed or uncompressed condition; dimples 36*g* are positioned slidably against the adjacent outer surface 30*h* of escutcheon plate main body portion 30*a* to provide a sliding relationship between the lower leg portion 36*e* and the escutcheon plate; handle 34 is positioned within the upper region of the bowl shaped main body portion 30*a* of the escutcheon plate with lugs 34*b* and 34*d* extending rearwardly through notches or slots 30*i* in the escutcheon plate; the upper ends of lugs 34*b*, 34*d* are fixably secured to a pivot shaft 46 positioned between escutcheon plate lugs 30*b*; and a coil spring 48 is positioned around pivot pin 46 with one end 48*a* of the spring positioned in a slot 36*h* in the upper leg portion 36*c* of the clip and bearing against the rear face of the escutcheon plate main body portion 30*a* proximate platform portion 30*c* and the other spring end 48*b* received in the aperture 34*f* defined by lug hook portion 34*c* so as to bias the handle 34 for return movement to the position seen in FIG. 5 in which it is nestled in the upper region of the bowl shaped main body portion 30*a* of the escutcheon plate.

Figure 4:
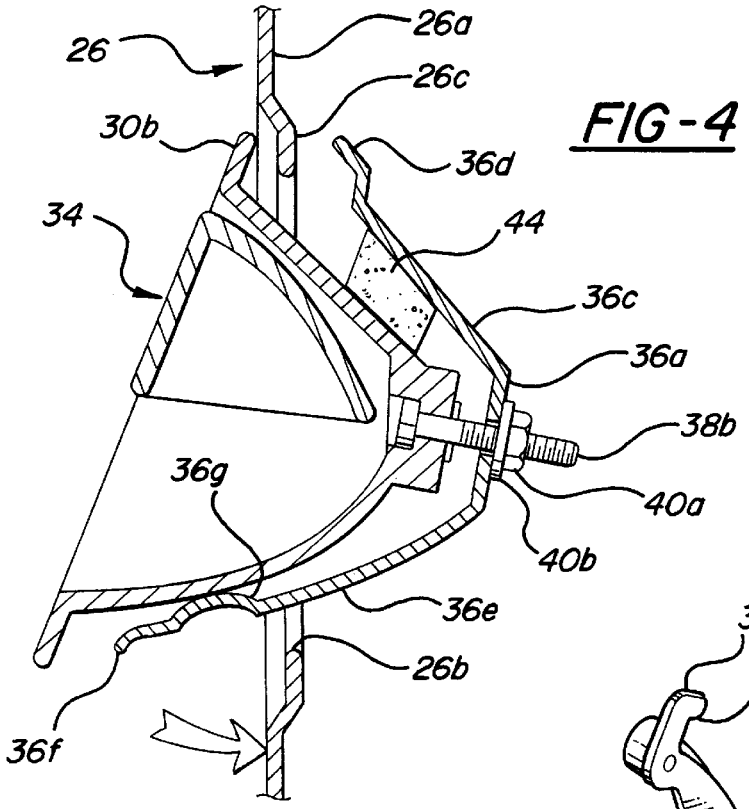
FIG. 4 illustrates the door handle assembly in the process of being installed in a vehicle door.
Figure 3:
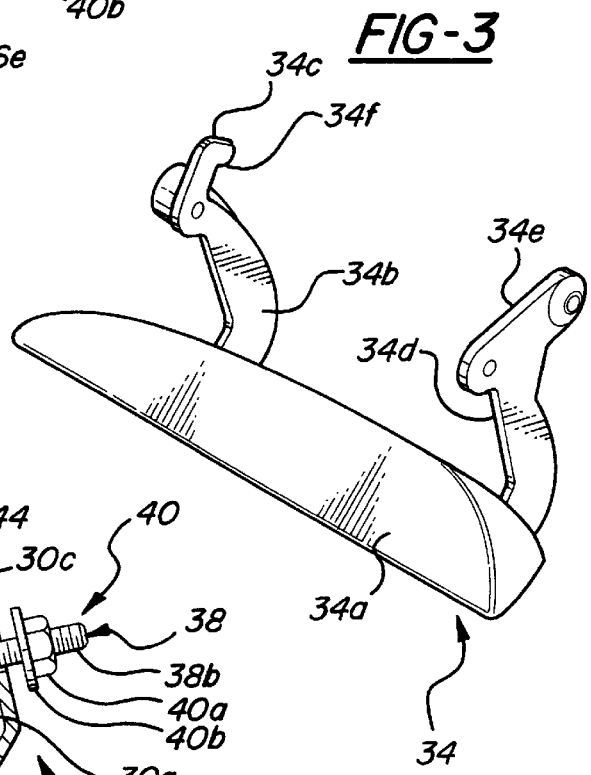
FIG. 3 is a perspective view of a door handle employed in the invention door handle assembly.

To mount handle assembly 10 in door 26, and following the formation in an outer door skin 26*a* of an aperture 26*b* defined by a flange portion 26*c*, the handle assembly is positioned as seen in FIG. 4 with clip edge flange 36*d* on one side of the upper portion of door flange 26*c* and the upper portion of the flange 30*b* of the escutcheon plate positioned on the other side of the flange 26*c*, whereafter the handle assembly is pivoted downwardly and inwardly about the pivot axis defined between clip portion 36*d* and escutcheon plate flange portion 30*b* to position the handle assembly in the door aperture 26*b* as seen in FIG. 5. In this position, flange 30*b* seats totally around the outer face of flange 26*c*; cushion member 44 is seated on the upper rear surface 30*g* of the escutcheon plate; dimples 36*g* are positioned slidably proximate surface 30*h* of the escutcheon plate; flange edge portion 36*d* of the upper arm portion is positioned proximate but spaced rearwardly from the rear face of the upper portion of door flange 26*c*; and flange edge portion 36*f* of the lower leg portion is positioned proximate but rearwardly of the inner face of the lower portion of door flange 26*c*. These positions are all seen in solid lines in FIG. 5.

After the door handle assembly has been installed in the door to assume the position seen in solid lines in FIG. 5, the installer reaches behind the outer door skin 26*a* and tightens the fastener device 38 and, specifically, turns nut 40 on threaded shaft 38*b* to move nut washer 40*b* against clip bight portion 36*a*. Thereafter, with continued threaded tightening movement of the nut on the threaded shaft, the clip is moved forwardly with respect to the escutcheon plate to the dotted line position seen in FIG. 5. Specifically, as the clip moves forwardly in response to tightening of the threaded fastener device the cushion member 44 is compressed, upper clip flange portion 36*d* moves forwardly into engagement with the inner face of upper door flange 26*c*, dimples 36*g* slidably guide on the surface 30*h* of the escutcheon plate as the lower clip leg portion slides downwardly and forwardly along the escutcheon plate to position clip flange portion 36*f* in engagement with the inner face of the lower portion of door flange 26*c*, and the clip adjusts pivotally as required to provide firm seating of the upper and lower clip flange portions with the pivotal movement being accommodated by the oversized relation of bight aperture 36*b* with respect to the threaded shaft 38*a* of the bolt. Following engagement of the clip flange portion 36*d* and the clip flange portion 36*f* with the door flange 26*c*, further tightening movement of nut 40 has the effect of splaying the flange portions 36*d*, 36*f* of the leg portions of the clip outwardly so as to introduce a spring bias force at the interface of the clip free edge portions and the flange 26*c* to augment the mounting force generated by the spring clip.

In the normal operation of the door, handle 34 is pivoted outwardly relative to the escutcheon plate about the axis of pivot pin 46 to move a control link 50 pivotally connected to the free end of crank arm portion 34*e* of handle lug 34*d* in a manner to unlatch a latch mechanism (not shown) associated with the door and allow opening of the door.

The invention door handle will be seen to minimize the labor costs required to install the door handle assembly in the vehicle door. Specifically, the only labor required after the handle has been positioned in the door aperture is tightening of the nut on the threaded shaft.

Whereas a preferred embodiment for the invention has been illustrated and described in detail, it will be apparent that various changes may be made in disclosed embodiment without departing from the scope or spirit of the invention.

I claim:

1. An automotive door handle assembly adapted to be mounted in an aperture defined in an outer skin of a motor vehicle door by a door flange having upper and lower edge portions and inner and outer faces, the handle assembly including:

an escutcheon plate sized to fit in the door aperture and having a main body central bowl portion and a peripheral flange extending around the bowl portion and adapted to seat against the outer face of the door flange;

a handle pivotally mounted on the escutcheon plate within the central bowl portion;

a threaded fastener device secured to the central bowl portion of the escutcheon plate and extending rearwardly therefrom;

a clip of U-configuration having a bight portion and upper and lower leg portions extending forwardly from opposite edges of the bight portion in outwardly splayed, outwardly diverging disposition relative to each other and having an aperture in the bight portion fitted over the threaded fastener device to position the clip rearwardly of the bowl portion of the escutcheon plate with the clip leg portions extending forwardly in embracing relation to the bowl portion of the escutcheon plate, the upper leg portion overlying an upper region of the bowl portion of the escutcheon plate and defining a forward clamping free edge flange for clamping engagement against the inner face of the upper edge portion of the door flange to clamp the door flange between the upper leg portion free edge flange and the peripheral flange of the escutcheon plate, the lower leg portion underlying a lower region of the bowl portion of the escutcheon plate and defining a forward clamping free edge flange for clamping engagement against the inner face of the lower edge portion of the door flange to clamp the door flange between the lower leg portion free edge flange and the escutcheon plate peripheral flange;

the handle assembly further including a resilient cushion member fitted between the upper clip leg portion and an adjacent surface of the upper region of the bowl portion of the escutcheon plate; and the handle assembly further including slide means positioned between the lower leg portion of the clip and an adjacent escutcheon plate surface to facilitate sliding movement of the clip lower leg portion on the adjacent escutcheon plate surface in response to tightening of the fastener device.

2. An automotive door handle assembly according to claim 1 wherein the slide means comprises a plurality of dimples upstanding from the front face of the clip lower leg portion and slidably engaging the adjacent escutcheon plate.

3. An automotive door handle assembly according to claim 1 wherein the threaded fastener device includes a threaded shaft extending rearwardly from the escutcheon plate and the aperture in the clip bight portion is oversized with respect to the threaded shaft so as to allow pivoting movement of the clip relative to the escutcheon plate as the clip moves forwardly in response to tightening of the fastener device.

4. A method of mounting an automotive door handle assembly in an aperture in an outer skin of a motor vehicle door, the handle assembly including an escutcheon plate, a handle pivotally mounted on the escutcheon plate, a threaded fastener device secured to the escutcheon plate and extending rearwardly therefrom, and a clip of U-configuration having a bight portion with an aperture adapted to be fitted over the threaded fastener device and upper and lower leg portions extending from opposite edges of the bight portion and defining upper and lower clamping edges spaced vertically by a distance exceeding the vertical height of the door skin aperture, the method comprising:

passing the door handle assembly, including the clip, through the aperture in the outer skin of the door to position a circumferential flange on the escutcheon plate against an outer face of the outer door skin in surrounding relation to the door skin aperture and position the clip inside the door with the upper and lower clamping edges of the upper and lower leg portions positioned proximate upper and lower portions of the edge of the door skin aperture; and, thereafter tightening the threaded fastener device from a location inside the door to move the clip forwardly relative to the escutcheon plate and move the upper and lower clamping edges of the clip leg portions respectively against the upper and lower portions of the edge of the door skin aperture to firmly mount the door handle assembly in the door aperture.

5. A method according to claim 4, wherein the leg portions of the clip are arranged in outwardly splayed, outwardly diverging disposition relative to each other; and, the upper and lower clamping edges of the upper and lower leg portions splay outwardly in response to forward movement of the clip upon tightening of the threaded fastener device.

6. A method according to claim 5 wherein:

the handle assembly includes a resilient cushion member fitted between one of the leg portions of the clip and an adjacent surface of the escutcheon plate; and the cushion member is compressed in response to forward movement of the clamp upon tightening of the fastener device.

7. A method according to claim 6 wherein:

the handle assembly further includes slide means positioned between the other clip leg portion and an adjacent surface of the escutcheon plate to facilitate a sliding movement of the other clip leg portion on the adjacent escutcheon plate surface; and the other leg slides forwardly on the adjacent escutcheon plate surface in response to forward movement of the fastener device.

* * * * *